US005911182A

United States Patent [19]

Uyama et al.

[11] Patent Number: 5,911,182

[45] Date of Patent: Jun. 15, 1999

[54] EMBROIDERY SEWING MACHINE AND EMBROIDERY PATTERN DATA EDITING DEVICE

[75] Inventors: Yoshiyuki Uyama; Akihiro Wakayama, both of Nagoya, Japan

[73] Assignee: Brother Kogyo Kabushiki Kaisha, Aichi-ken, Japan

[21] Appl. No.: 09/160,673

[22] Filed: Sep. 25, 1998

[30] Foreign Application Priority Data

Sep. 29, 1997 [JP] Japan ..... 9-282595

[51] Int. Cl.[6] ..... D05B 21/00; D05C 5/06

[52] U.S. Cl. ..... 112/102.5; 364/470.09

[58] Field of Search ..... 112/102.5, 470.04, 112/470.06, 475.19; 364/470.08, 470.09, 470.07

[56] References Cited

U.S. PATENT DOCUMENTS

| | | | |
|---|---|---|---|
| 5,559,711 | 9/1996 | Futamura et al. | 112/470.06 X |
| 5,751,583 | 5/1998 | Kyuno et al. | 364/470.09 X |
| 5,791,271 | 8/1998 | Futamura | 112/102.5 |

FOREIGN PATENT DOCUMENTS

| | | | |
|---|---|---|---|
| 3-247388 | 11/1991 | Japan . | |
| 5-285282 | 11/1993 | Japan . | |
| 7-058927 | 3/1995 | Japan . | |
| 7-185159 | 7/1995 | Japan . | |
| 7-185161 | 7/1995 | Japan . | |
| 7-236784 | 9/1995 | Japan . | |
| 7-308470 | 11/1995 | Japan . | |
| 8-013313 | 1/1996 | Japan . | |
| 8-294589 | 11/1996 | Japan . | |
| 8-294590 | 11/1996 | Japan . | |
| 63-242297 | 10/1998 | Japan | 112/470.04 |

*Primary Examiner*—Peter Nerbun

*Attorney, Agent, or Firm*—Kane, Dalsimer, Sullivan, Kurucz, Levy, Eisele and Richard, LLP

[57] ABSTRACT

When a handy scanner 8 reads a standard sewing designation mark 45 drawn in advance on a work sheet 39 held by an embroidery frame 34, the sewing data on an embroidery pattern to be sewn can be edited so that the position and direction and the pattern size at the time the embroidery pattern is actually sewn on the work sheet 39 correspond to the position and direction and the pattern size indicated by the standard mark 45. Accordingly, the sewing data can be simply edited only if the work sheet 39 is set in the embroidery frame 34, without manual operations, resulting in a large improvement of the efficiency of sewing work.

26 Claims, 15 Drawing Sheets

EMBROIDERY SEWING MACHINE AND EMBROIDERY PATTERN DATA EDITING DEVICE

BACKGROUND OF THE INVENTION

1. Field of the Invention

The present invention relates to an embroidery sewing machine and an embroidery pattern data editing device, and more particularly to those which execute automatic edits to sewing data on embroidery patterns to be embroidered so that the location and direction, and pattern size at the time the embroidery pattern is sewn are equal to those indicated by a sewing designation mark that has been drawn in advance on a work sheet.

2. Description of Related Art

Conventional home-use or domestic embroidery sewing machines of electronic control type are provided with a sewing mechanism including a sewing needle which is driven to vertically reciprocate and a thread loop catcher, or a hook, a feed mechanism for moving an embroidery frame whereby a work sheet such as a cloth is removably held, in each of two directions intersecting each other at right angles, a pattern data memory for storing pattern data on a plurality of embroidery patterns of, for example, "vehicles", "flowers", and "animals", and a display and a control panel. An operator operates the control panel and others to display a desired embroidery pattern and start embroidery sewing processing. The driving mechanism is controlled based on the selected pattern data such that the desired embroidery pattern with plural colors are sewn on the work sheet held by the embroidery frame by the sewing mechanism in cooperation with the driving mechanism.

Meanwhile, the embroidery pattern needs to be sewn at a predetermined location, in a designated direction, and in a designated size. To meet those three requirements, at first, the work sheet must be set in the embroidery frame in an accurate location and direction. Second, the sewing data that has been produced in advance must be edited to satisfy those sewing requirements.

Here, a simple explanation is made below on how to normally set a work sheet in an embroidery frame. The work sheet as stretched is put on an outer frame, while a positioning sheet is attached to an inner frame.

Subsequently, the work sheet is displaced to adjust its location on the outer frame so that a reference line (consisting of a vertical and lateral lines) printed on the positioning sheet coincides with a reference mark (e.g., a mark "+") that has been drawn in advance on the work sheet. The inner frame is then attentively inserted in the outer frame so that the reference mark does not deviate from the reference line. The work sheet is thus pinched between the outer and inner frames and set in the embroidery frame. If the reference mark deviates from the reference line even by a short distance or the direction of the work sheet to the frame inclines with respect to the reference line, furthermore, if the work sheet is not sufficiently stretched, the above setting operations of the work sheet in the embroidery frame should be repeated while detaching and attaching the work sheet from/to the outer frame to modify the location and direction of the work sheet and adjusting the stretching state of the same until all of the requirements are satisfied.

If satisfactory setting of the work sheet in the embroidery frame is completed, the sewing data produced in advance is edited to meet the sewing conditions and then embroidery patterns are sewn on the work sheet based on the edited sewing data.

For example, there is proposed an automatic sewing machine in Japanese patent (JP) application laid-open under publication No. 63(1988)-242297, in which, in case of sewing practical stitches such as a straight line, a preset stitch line for the practical stitch is drawn in advance on a work sheet and read in by an image sensor. Based on the stitch line taken by the image sensor, a pattern corresponding to the stitch is sewn on the work sheet.

In JP application laid-open No. 7(1995)-185159, disclosed is an embroidery sewing machine in which images of selected characters are displayed on an image plane or screen to execute thereon various edits, e.g., expansion and contraction of the image in each of vertical and lateral directions, oblique transformation like italic type font, or the fan-shaped arrangement of the characters in a curved line. In accordance with the edited image, an embroidery frame is adjusted to be placed at a start location of embroidery sewing.

Furthermore, in JP application laid-open No. 8(1996)-294590 is disclosed an embroidery sewing machine wherein an embroidery frame is moved to align a reference point imparted to a work sheet at a position below the needle and the reference point is registered, while a cross line is displayed on a screen. An embroidery pattern is sewn after the alignment of the cross line to the center of a pattern displayed on the screen.

As mentioned above, if using a positioning sheet to set a work sheet in an embroidery frame so that a reference line of the sheet coincides with a reference mark provided on the work sheet, the above mentioned troublesome modifying or adjusting operations while attaching and detaching the work sheet to/from the frame must be repeated until the requirements for setting of a work sheet in the frame, specifically, the location and direction, and the stretched state of work sheet, are all satisfied. Consequently, the embroidery sewing process requires a complicated preparatory work of setting the work sheet in the embroidery frame and great deal of time thereto, thus causing a deterioration in the efficiency of sewing work.

In the embroidery sewing machines disclosed in JP applications laid-open Nos. 7-185159 and 8-294590, final sewing data is first produced by edits such as expansion and contraction of sewing data on embroidery patterns to be sewn at a predetermined enlargement rate in each of a vertical and lateral directions. After the sewing start point (sewing reference point) on the work sheet is aligned with the needle by movement of the embroidery frame, an embroidery sewing process is started. Accordingly, such the movement of the embroidery frame by a short distance for the alignment to the needle requires complicated preparatory operations before sewing, and a lot of time. The edit processing requires key control with various keys to input parameter and the like. Similar to the above, there are also problems such as a complicated preparatory work and a deterioration in the sewing efficiency.

The automatic sewing machine disclosed in JP application laid-open No. 63(1988)-242297 executes the sewing of practical stitches simply based on the preset stitch line that has been drawn in advance on the work sheet and read in by the image sensor. This machine is not designed so as to be able to designate sewing conditions such as the size and direction of an embroidery pattern to be formed with a plane region.

SUMMARY OF THE INVENTION

The present invention has been made in view of the above circumstances and has an object to overcome the above problems and to provide an embroidery sewing machine and an embroidery pattern data editing device capable of automatically editing pattern data on embroidery patterns so as to be sewn in a desired position and direction and size according to a setting state of work sheet in an embroidery frame.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an embroidery sewing machine including an embroidery frame which holds a work sheet on which a sewing designation mark has been drawn in advance, a pattern data memory which stores pattern data on a plurality of embroidery patterns, an image reading device for reading the sewing designation mark drawn on the work sheet, means for analyzing image data of the sewing designation mark read by the image reading device to determine at least one of a first sewing position and a first sewing direction of an embroidery pattern to be sewed on the work sheet, means for editing the pattern data, prior to sewing of the embroidery pattern on the work sheet based on the pattern data read from the pattern data memory, so that one of a second sewing position and a second sewing direction of the embroidery pattern in the pattern data corresponds to one of the first sewing position and the first sewing direction of the embroidery pattern determined by the mark analysis means, and a sewing device which sews the embroidery pattern on the work sheet held in the embroidery frame based on the pattern data edited by the edit means.

In the above embroidery sewing machine, when the image reading device reads the sewing designation mark such as a straight line with an arrow drawn in advance on the work sheet set in the embroidery frame, the mark analysis means determines any at least one of the position and direction of the embroidery pattern to be sewn on the work sheet based on the image data of the sewing designation mark read by the image reading device. The edit means receives the pattern data on the embroidery pattern to be sewn from the pattern data memory and edits the pattern data by changing coordinates thereof so that any one or both of the position and direction at the time the embroidery pattern is actually sewn correspond to any one or both of the position and direction determined by the mark analysis means. Accordingly, based on the edited pattern data, the selected embroidery pattern can be sewn with ease in accordance one or both of the position and direction indicated by the sewing designation mark.

According to another aspect of the present invention, there is provided an embroidery pattern data editing device including a pattern data memory which stores pattern data on a plurality of embroidery patterns, an image reading device for reading a sewing designation mark that has been drawn in advance on a work sheet held in an embroidery frame, means for analyzing image data of the sewing designation mark read by the image reading device to determine at least one of a first sewing position and a first sewing direction of an embroidery pattern to be sewed on the work sheet, and means for editing the pattern data, prior to sewing of the embroidery pattern on the work sheet based on the pattern data read from the pattern data memory, so that one of a second sewing position and a second sewing direction of the embroidery pattern in the pattern data corresponds to one of the first sewing position and the first sewing direction of the embroidery pattern determined by the mark analysis means.

According to another aspect of the present invention, there is provided an embroidery sewing machine including an embroidery frame which holds a work sheet on which a sewing designation mark has been drawn in advance, a pattern data memory which stores pattern data on a plurality of embroidery patterns, an image reading device for reading the sewing designation mark drawn on the work sheet, means for analyzing image data of the sewing designation mark read by the image reading device to determine a first sewing position, a first sewing direction, and a pattern size of an embroidery pattern to be sewed on the work sheet, means for editing the pattern data, prior to sewing of the embroidery pattern on the work sheet based on the pattern data read from the pattern data memory, so that a second sewing position, a second sewing direction of the embroidery pattern, and a pattern size in the pattern data respectively corresponds to the first sewing position, the first sewing direction, and the pattern size of the embroidery pattern determined by the mark analysis means, and a sewing device which sews the embroidery pattern on the work sheet held in the embroidery frame based on the pattern data edited by the edit means.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of one preferred embodiment of an embroidery sewing machine and an embroidery pattern data editing device embodying the present invention will now be given referring to the accompanying drawings. The embroidery sewing machine in the embodiment is an electronic control type of embroidery sewing machine removably attached with an embroidering device, whereby to sew various embroidery patterns.

Figure 1:
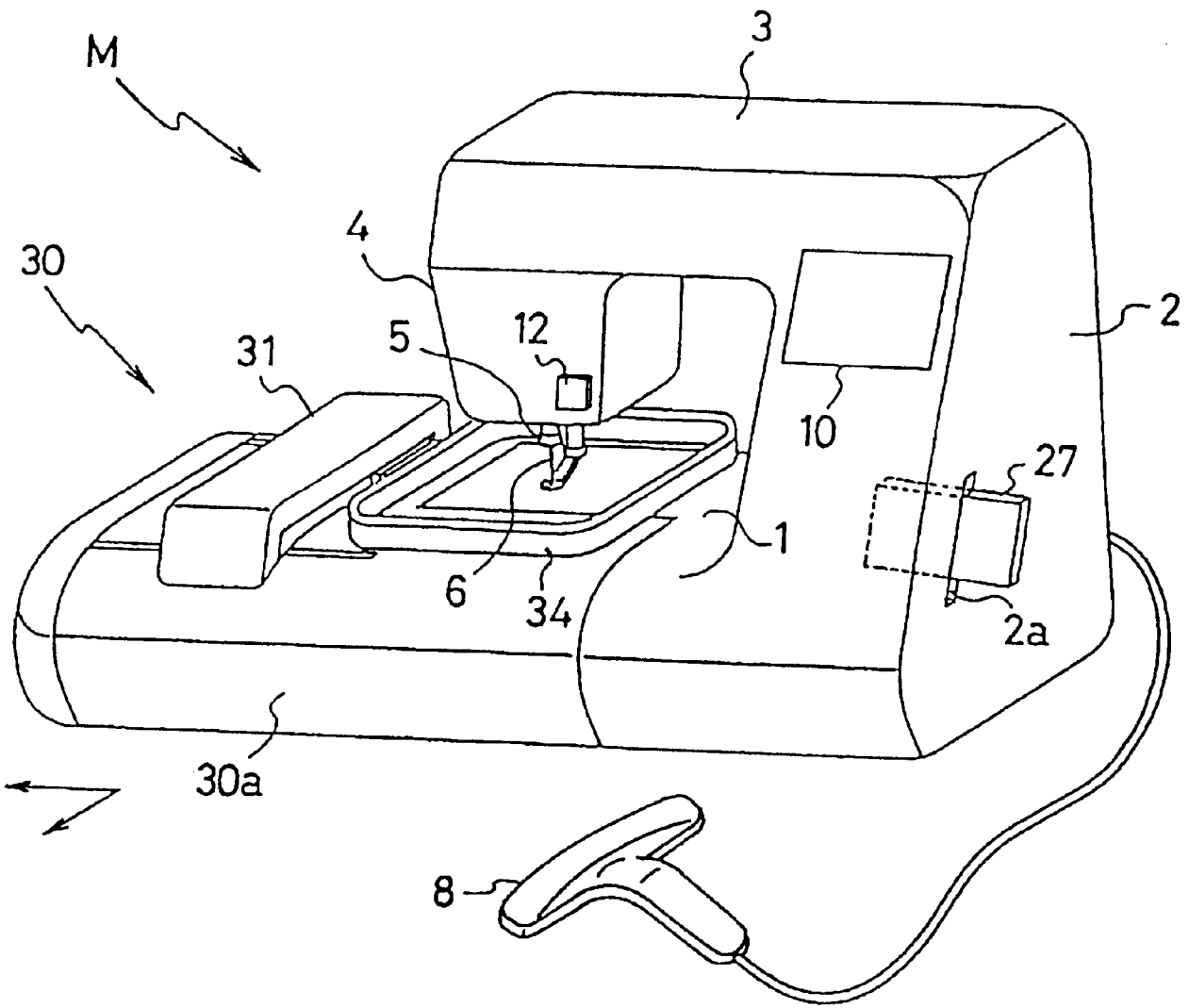
FIG. 1 is a perspective view of an electronic embroidery sewing machine in an embodiment according to the present invention.

As shown in FIG. 1, an electronic control type of embroidery sewing machine M is provided with a main bed portion 1, a column portion 2 provided upright extending on the bed portion 1 at the right side thereof, and an arm portion 3 provided extending leftwards from the upper end of the column portion 2, in parallel to the bed portion 1.

In the bed portion 1 are provided a feed dog up-and-down reciprocation mechanism (not shown) for vertically reciprocating feed dogs, a feed dog back-and-forth reciprocation mechanism (not shown) for reciprocating the dogs back and forth, and a thread loop catcher, namely, a horizon hook for holding a bobbin therein and cooperating with a sewing needle 6. The column portion 2 is formed with a slot 2*a* in which a ROM card 27 is inserted to be connected with a connector 18 (see FIG. 2) provided in the column portion 2. The ROM card 27 stores pattern data (sewing data and pattern display data) on a plurality of embroidery patterns that may be optionally added. A handy scanner 8 for reading images is connected to a control unit 20 which will be mentioned later through a main frame of the bed portion 1.

In the arm portion 3 are provided a needle bar drive mechanism for driving a needle bar 5 to be attached with the needle 6 at a lower end of the bar 5, a needle bar swing mechanism (not shown) for swinging the needle bar 5 in a perpendicular direction to a work sheet feeding direction, and a thread take-up lever drive mechanism (not shown) for reciprocating the thread take-up lever up and down in correspondence with the vertical reciprocation of the needle bar 5. Note that a sewing machine motor 14 drives the feed dog up-and-down drive mechanism, the needle bar drive mechanism, and the thread take-up lever drive mechanism (see FIG. 2). A stepping motor 15 drives the needle bar swing mechanism. A stepping motor 16 drives the feed dog back-and-forth reciprocation mechanism. A start/stop switch 12 for issuing a command to start/stop sewing operation is provided in a head 4 of the arm portion 3.

On a front surface of the arm portion 3, a liquid crystal display (LCD) 10 is provided to display various stitch pattern images such as practical patterns and embroidery patterns, various function names, and various messages. Touch keys 11 made of transparent electrodes are provided in a matrix form on the LCD 10, each of the touch keys 11 corresponding to each displaying position of plural embroidery patterns and function names. Specifically, the selection of desired embroidery patterns and functions can be executed by depression of the touch keys 11 corresponding to the desired embroidery patterns and functions.

A free bed portion commonly called a free arm is formed on the left side of the bed portion 1. An embroidering device 30 is removably mounted on the free bed portion.

The embroidery device 30 is provided with a body case 30*a*, an embroidery frame 34 for supporting a work sheet 39 such as cloth, fabric, or the like (see FIG. 10), a holding case 31 having a Y-direction feed mechanism built therein for moving the frame 34 in a Y-direction (back-and-forth direction), and an X-direction feed mechanism for moving the holding case 31 with the Y-direction feed mechanism in an X-direction (right-and-left direction), the X-direction feed mechanism being provided in the body case 30*a*. A first stepping motor 32 drives the X-direction feed mechanism and a second stepping motor 33 drives the Y-direction feed mechanism (see FIG. 2).

Upon attachment of the embroidering device 30 to the free bed portion, the first and second stepping motors 32 and 33 are electrically connected via a connector 19 to the control unit 20 of the sewing machine M. The control unit 20 operates to drive the first and second stepping motors 32 and 33 to move the embroidery frame 34 and the work sheet 39 in each of the X-direction and the Y-direction, independently. This brings the sewing machine M in a state capable of sewing embroidery patterns. The embroidering device 30, the needle drive mechanism, and the thread take-up lever drive mechanism constitute a sewing device.

Next, description will be given to the control system of the embroidery sewing machine M.

Figure 2:
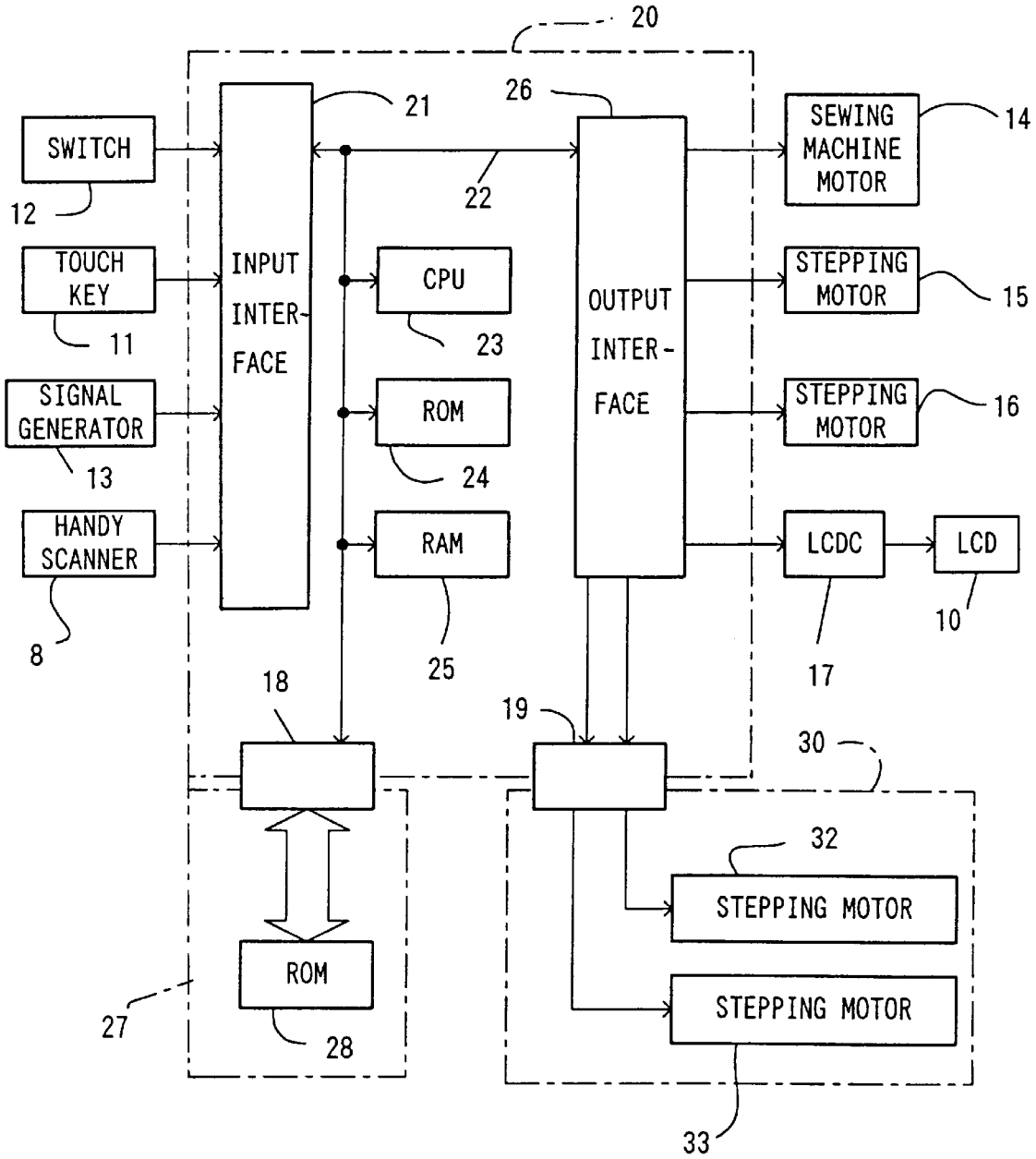
FIG. 2 is a block diagram of a control system of the embroidery sewing machine.

As shown in FIG. 2, the control unit 20 is constituted of an input interface 21, a computer including a CPU 23, a ROM 24, and a RAM 25, an output interface 26, and a bus 22 which connects those elements to each other.

To the input interface 21 are connected the start/stop switch 12, the touch keys 11, a timing signal generator 13 for detecting plural rotation phases of a principal axis of the sewing machine, and the handy scanner 8. To the output interface 26 are connected the sewing machine motor 14, the stepping motor 15 for swinging the needle, the stepping motor 16 for driving the feed dog, a display controller (LCDC) 17 for driving the LCD 10, and the connector 19 to which the first and second stepping motors 32 and 33 of the embroidering device 30 are connected. A ROM 28 of the ROM card 27 is to be connected to the bus 22 via a connector 18.

The ROM 24 (corresponding to a part of pattern data memory) pre-stores ordinary control programs such as a sewing control program for sewing a practical pattern and a display control program. It also pre-stores control programs for embroidery pattern sewing control characteristic of the present application which will be described later. The control programs characteristic of the present application involve an edit control program for conducting various edits such as enlargement and rotation of a selected sewing pattern and a sewing processing control program for embroidering the selected embroidery pattern.

Figure 3:
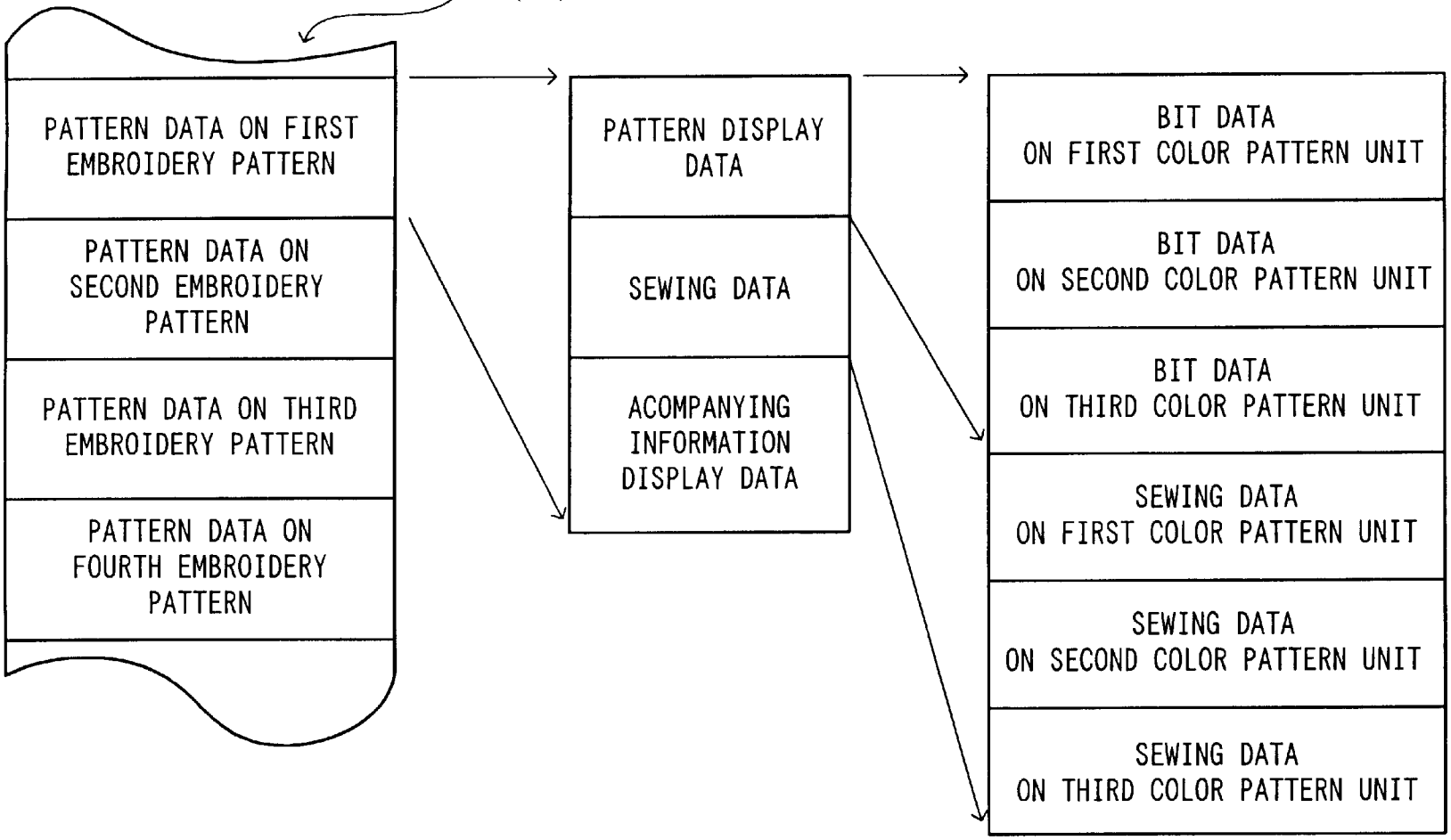
FIG. 3 is a diagram for explaining the structure of various data stored in a ROM of the machine and in a ROM of a ROM card.

Furthermore, the ROM 24 stores letter design data consisting of display data on figure and alphabetical patterns and of their sewing data and practical pattern data consisting of display data on a plurality of practical patterns and of their sewing data. It also stores, as shown in FIG. 3, pattern data on many embroidery patterns (the first embroidery pattern, the second embroidery pattern, the third embroidery pattern, etc.) which are used with relatively high frequency. The pattern data on these many embroidery patterns are classified into pattern types, allotted with pattern number and stored therein.

A plurality of cards are prepared as ROM cards 27. The ROM 28 of each of the ROM cards 27 stores, as shown in FIG. 3, design data on many embroidery patterns (the first embroidery pattern, the second embroidery pattern, the third embroidery pattern, etc.) which are used with relatively low frequency and pattern data on embroidery patterns such as various types of letters, diagrams and images, marks and characters (such as TV or movie personae, animals and robots). They are classified into types and recorded in the ROM 28 as in the case of the ROM 24.

Specifically, since pattern data on the embroidery patterns are of similar structure, that on the first embroidery pattern will now be typically described. As shown in FIG. 3, pattern data are divided into pattern display data for displaying embroidery patterns and a plurality of color pattern units included in the embroidery patterns, sewing data for embroidery and accompanying information display data for displaying accompanying information on image planes.

The first embroidery pattern display data stores bit data on first through third color pattern units to display three different color pattern sections. In case of the embroidery pattern of "panda" shown in FIG. 4, the pattern units consist of the first color pattern unit of "a face (white)", the second color pattern unit of "a book (red)" and the third color pattern unit of "rings around eyes, ears, paws, face contour and an excitement mark (black)".

Figure 4:
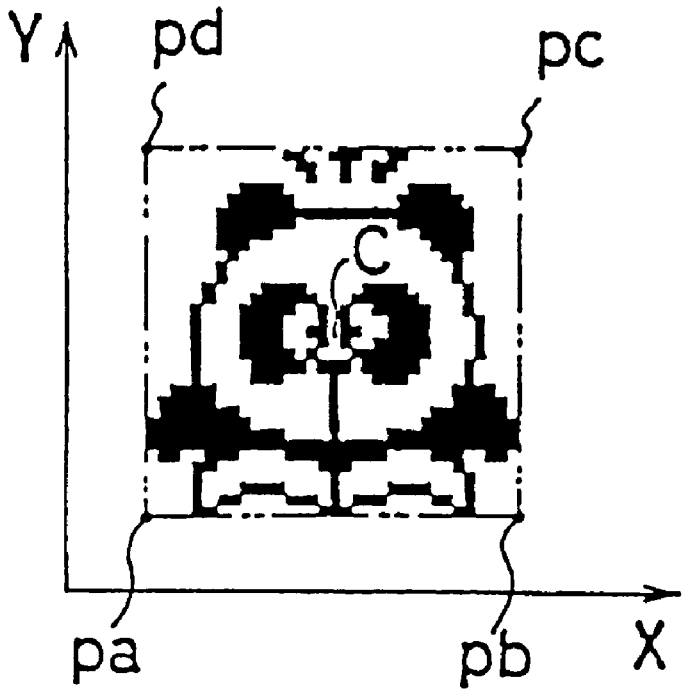
FIG. 4 is an explanatory view for showing sewing data on an embroidery pattern of "panda"

As for sewing data, three-color sewing data (needle location data) on the above-stated first to third color sewing units in the embroidery pattern of "panda" is stored respectively. As for accompanying information display data, display data for characters and function names to be displayed on each image plane of those color pattern units are stored. Specifically, each sewing data on those color pattern units consists of coordinate data on many needle locations based on the origin of the X-Y coordinate system. The sewing data on the embroidery pattern of "panda" consisting of those three color sewing data is shown in FIG. 4. Here, the sewing data contain four base points $P_a$ to $P_d$ indicating the external size of the rectangular "panda" pattern.

The above-stated RAM 25 is provided with memories (those for flags, pointers, counters, registers, buffers etc.) necessary for various control operations.

Figure 5:
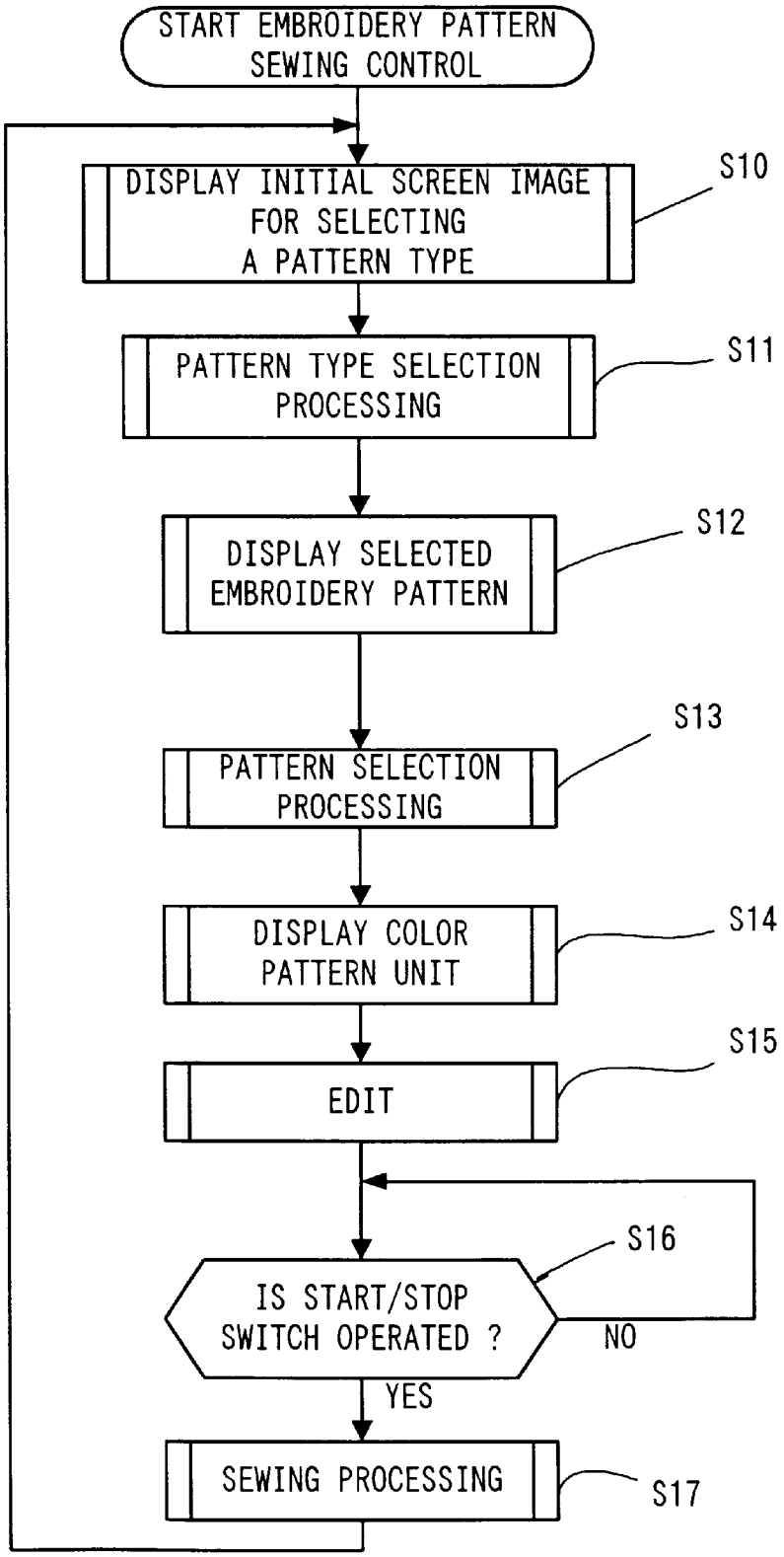
FIG. 5 is a flowchart showing a routine of embroidery pattern sewing control.

Next, an embroidery pattern sewing control routine to be executed by the control unit 20 will be described, referring to the flowchart of FIG. 5. Reference symbols Si (i=10, 11, 12 . . . ) indicate steps therein.

When the power is turned on and a control operation starts, an initial screen for selecting a pattern type (classification) appears on the display 10 (in step S10).

Figure 7:
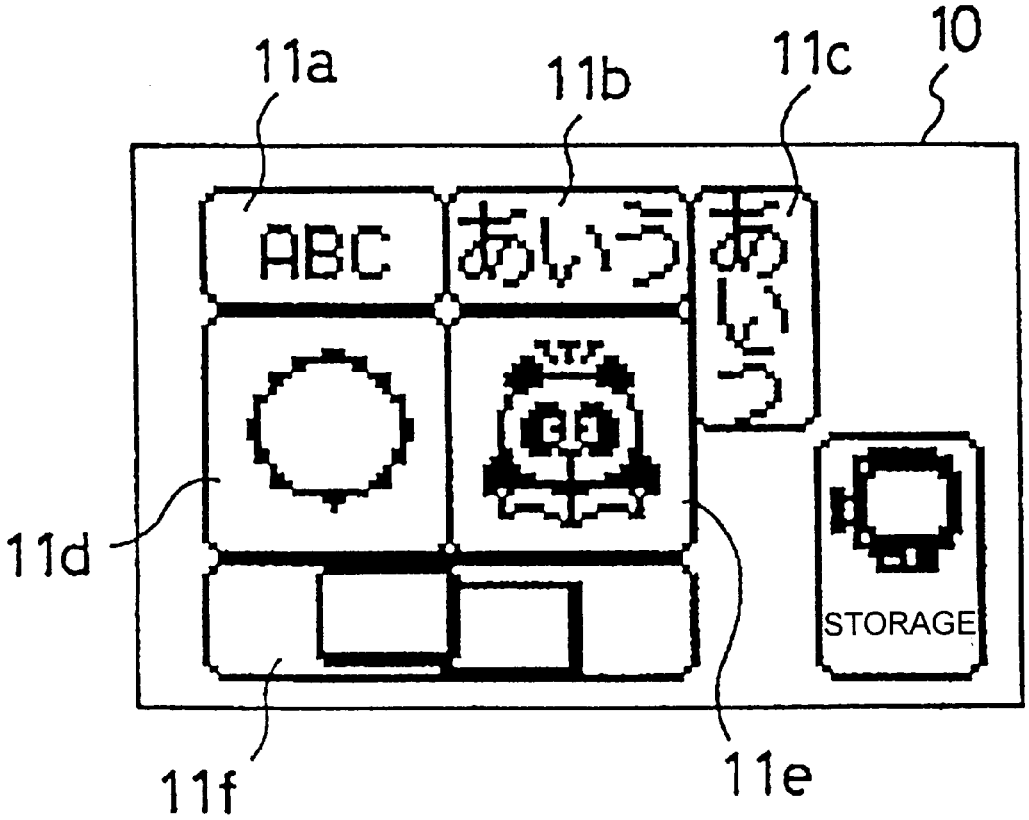
FIG. 7 is a schematic view of an initial screen image appearing on a liquid crystal display.
Figure 8:
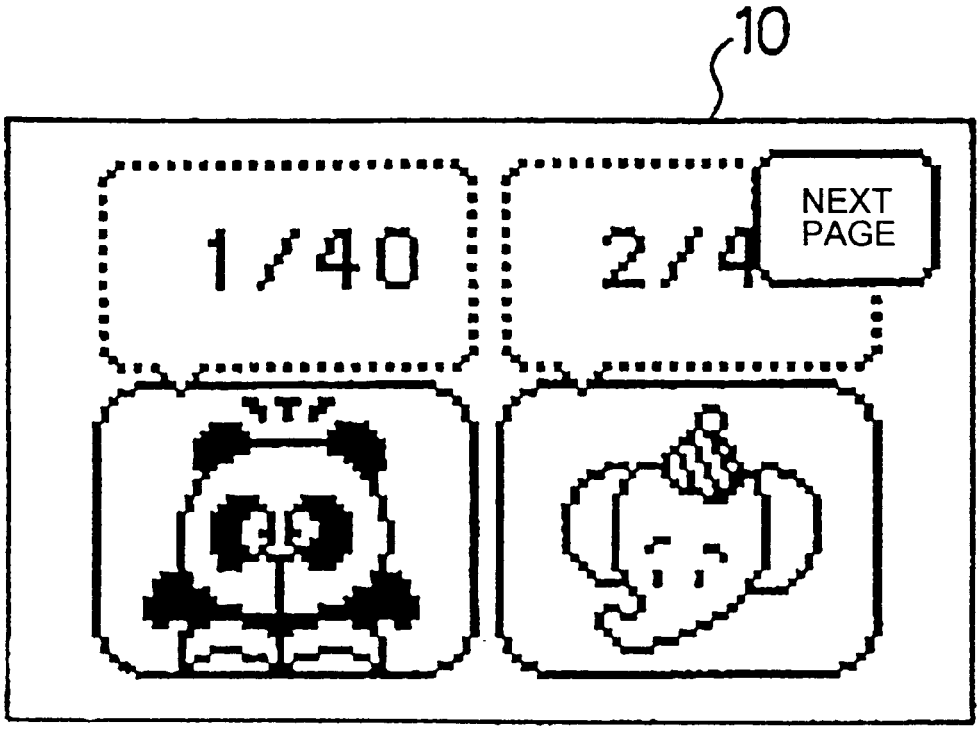
FIG. 8 is a schematic view of a screen image when an "animal" pattern is selected from among a group of embroidery patterns.

As shown in FIG. 7, for example, the initial screen (pattern type selection screen) including pattern selection keys 11*a* to 11*c* for selecting a letter pattern, a pattern selection key 11*d* for selecting a practical pattern, a pattern selection key 11*e* for selecting an embroidery pattern and a pattern selection key 11*f* for selecting an embroidery pattern from those stored in the installed ROM card 27 is displayed on the display 10.

If pattern type selection processing for selecting the type of a desired pattern group by pressing the touch key 11 corresponding to the type is executed (in step S11), many embroidery patterns included in the selected pattern group are displayed by a predetermined number at a time (in step S12).

If an embroidery pattern group stored in the ROM 24 is selected by operating the pattern selection key 11*e*, the first embroidery pattern "panda (1/40)" and the next pattern "elephant (2/40)" are displayed from among the pattern group having 40 embroidery patterns relating to animals and vehicles. By operating the key "next page", following embroidery patterns can be consecutively displayed.

Next, if pattern selection processing is executed by operating the touch key 11 corresponding to a desired embroidery pattern (in step S13), color pattern units included in the selected embroidery pattern are displayed on the display 10 (in step S14).

Figure 9:
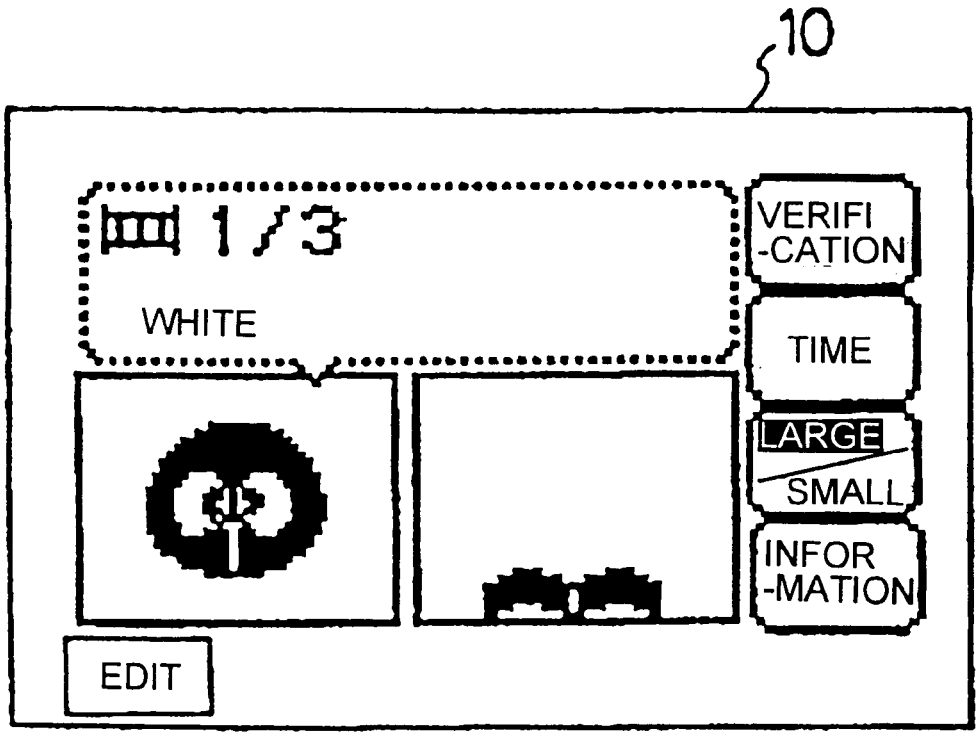
FIG. 9 is a schematic view of a screen image of a color pattern unit included in the "panda" pattern.

When the animal "panda" is selected, for example, the first and next color pattern units from among the three color pattern units included in the embroidery pattern of "panda" appear on the display 10 as shown in FIG. 9. At the same time, four function keys including "VERIFICATION" and "TIME" appear on the right end portion of the display 10. Here, the "VERIFICATION" key is one for verifying color of a thread to be used for embroidery sewing operation. The "TIME" key is one for displaying a time needed for sewing operation. The "LARGE/SMALL" key is one for switching the size of embroidery patterns. The "INFORMATION" key is one for displaying various information on how to use the sewing machine, how to sew, and maintenance of the sewing machine.

Figure 6:
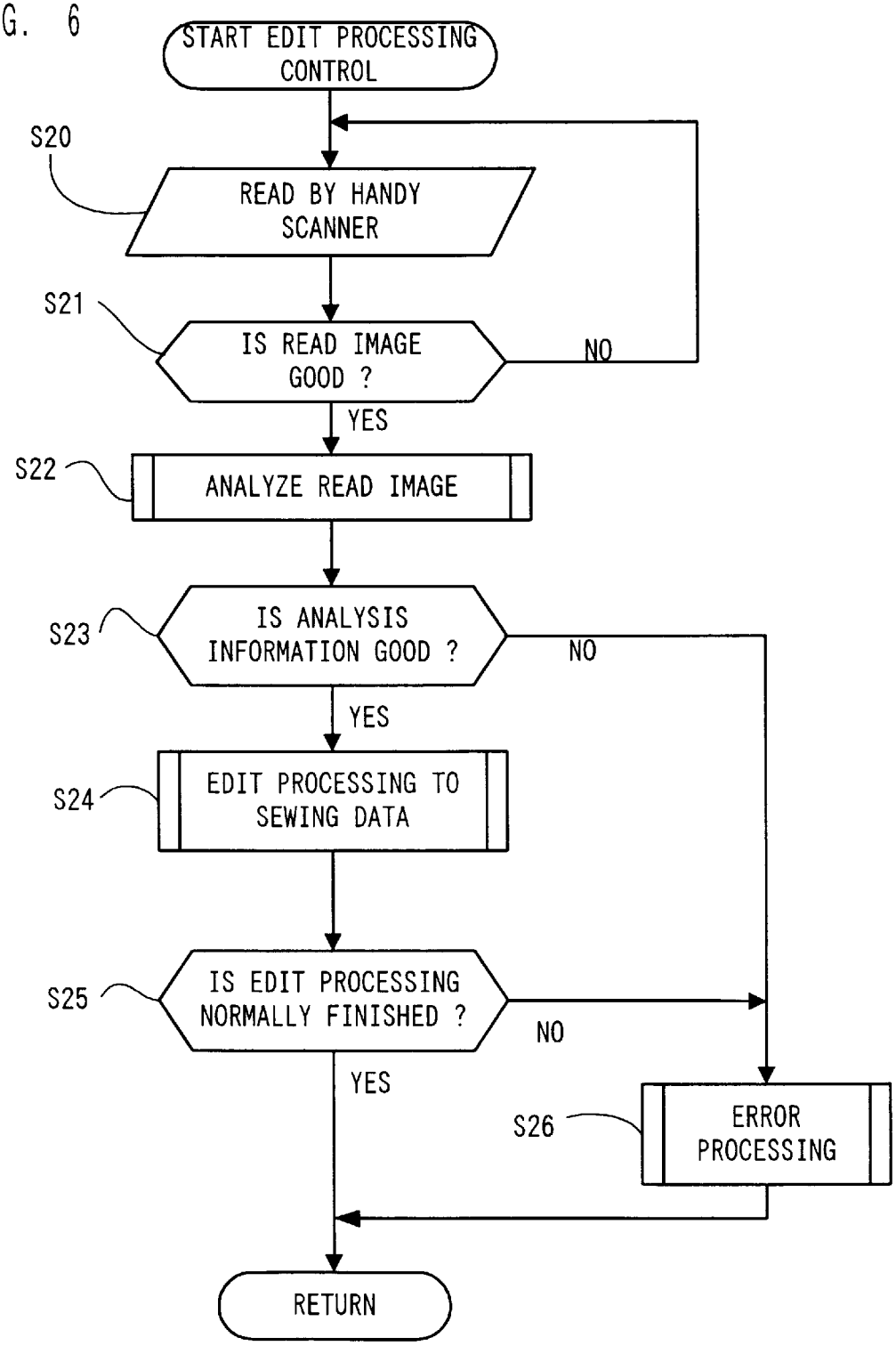
FIG. 6 is a flowchart showing a routine of edit control.

Meanwhile, by operating the function key of "EDIT" appearing on the color pattern display screen, edit control for editing sewing data is executed such that the location, direction and pattern size at the time the embroidery pattern is sewn are equal to those indicated by a sewing designation mark drawn on a work sheet such as a cloth (in step S15) (see FIG. 6).

Figure 10:
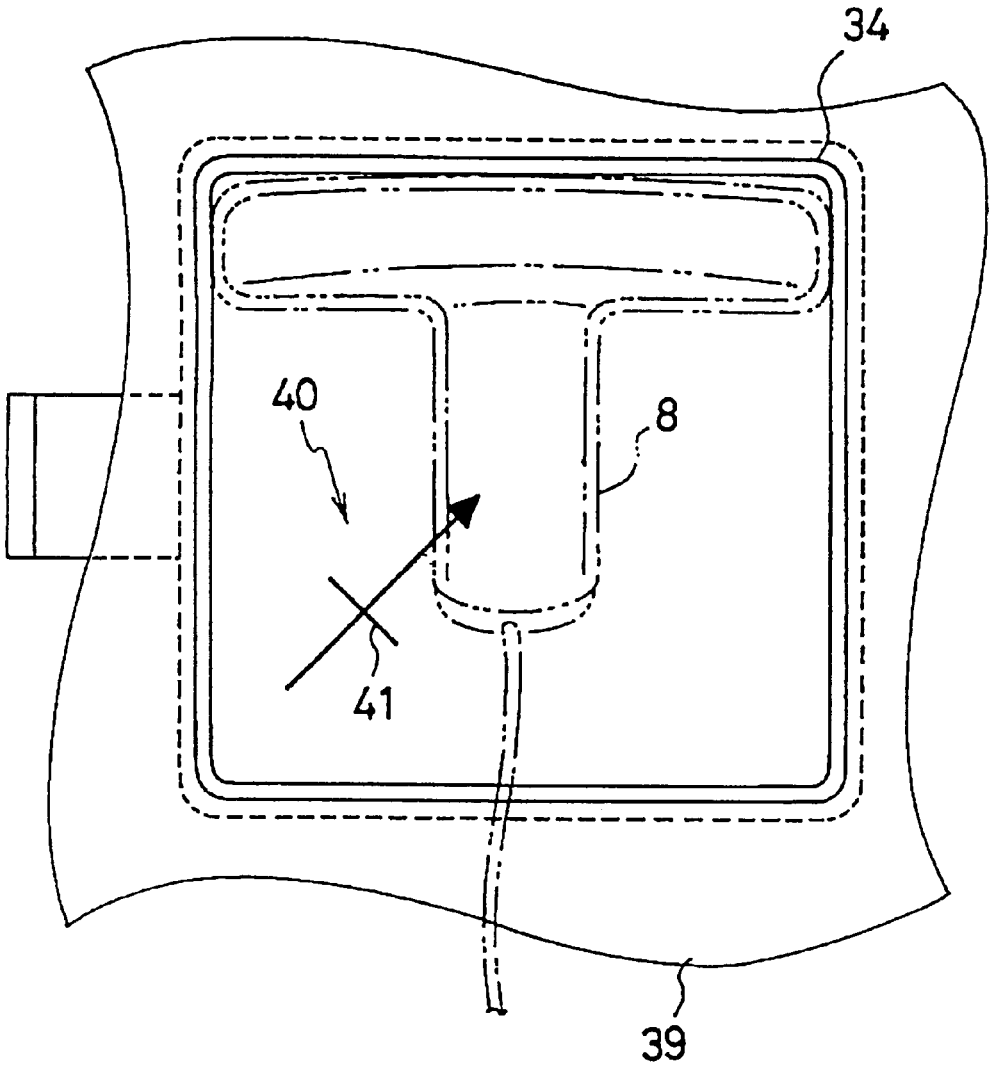
FIG. 10 is a plan view of an embroidery frame in which a work sheet with a simple sewing designation mark is set.

As shown in FIG. 10, the work sheet 39 such as a cloth, fabric, or the like is set in an embroidery frame 34 by the time the edit control starts. A simple sewing designation mark 40 made up of a cross with an arrow is drawn on the surface of the work sheet with a tailor's chalk.

The work sheet may be easily set in the embroidery frame 34 by only taking care to position the simple sewing designation mark 40 that has been drawn in advance on the work sheet 39 within the embroidery frame 34.

When the edit control starts, a message "READ SEWING DESIGNATION MARK DRAWN ON WORK SHEET" appears on the display 10. In response to this message, as shown in FIG. 10, an operator moves the handy scanner 8 manually toward the operator while guiding the scanner 8 within the embroidery frame 34 to read the simple sewing designation mark 40 from the work sheet (in step S20).

Next, image data on the simple sewing designation mark 40 which has been read in by the handy scanner 8 is retrieved. If the read image data on the simple sewing designation mark 40 is good, that is, the handy scanner 8 is surely moved by a predetermined distance and in a predetermined direction within the embroidery frame 34 and image data on straight lines and an arrow constituting the simple sewing designation mark 40 is clear without any defections (S21:Yes), then the image data on the read mark 40 is analyzed (S22). Specifically, in this analysis processing, image data on the straight lines and an arrow constituting the simple sewing designation mark 40 is analyzed and a designation position and a designated direction to sew an embroidery pattern on the work sheet 39 are obtained.

If analysis information as a result of the analysis is good, that is, if a sewing designation position (the point of intersection between the two straight lines constituting the simple sewing designation mark 40) 41 and a designation direction (the direction of the pattern designated by the arrow) are accurately obtained (S23:Yes), then an edit processing is executed to the sewing data on the selected embroidery pattern such that the pattern is on the sewing designation position 41 and in the designated direction obtained as a result of the analysis (S24).

More specifically, the sewing designation position 41 and the designation direction are obtained based on the image data on the simple sewing designation mark 40 shown in FIG. 10. In case of the embroidery pattern of "panda", coordinate data on needle locations is changed so that center point C (see FIG. 4) of the external dimensions, which is obtained from four base points $P_a$ to $P_d$, is aligned to the sewing designation position 41, and the coordinate data on the needle locations is further changed so that the direction of the embroidery pattern is equal to the designation direction obtained. Needless to say, when the embroidery pattern to be sewn includes a plurality of color patterns, the edit processing is executed for every sewing data on each color pattern.

Next, if the sewing data edit processing has been normally finished, that is, if the pattern can be embroidered while the sewing data edited according to the sewing designation position 41 and the designated direction are not shifted externally (S25:YES), then the control is finished and operation is returned to step S16 for embroidery pattern sewing control. However, if various defects exist on the analysis information as a result of analysis processing (S23:NO) or if sewing data edit processing is finished abnormally (S25:NO), then error processing is executed by, for example, displaying an error message on the display 10 (S26).

In embroidery pattern sewing control, if a start/stop switch 12 is depressed (S16:YES), a sewing machine motor 14 and an embroidery device 30 are activated to thereby execute sewing processing, i.e., sewing the embroidery pattern (S17). When the pattern is embroidered, operation is returned to step S10.

Figure 11:
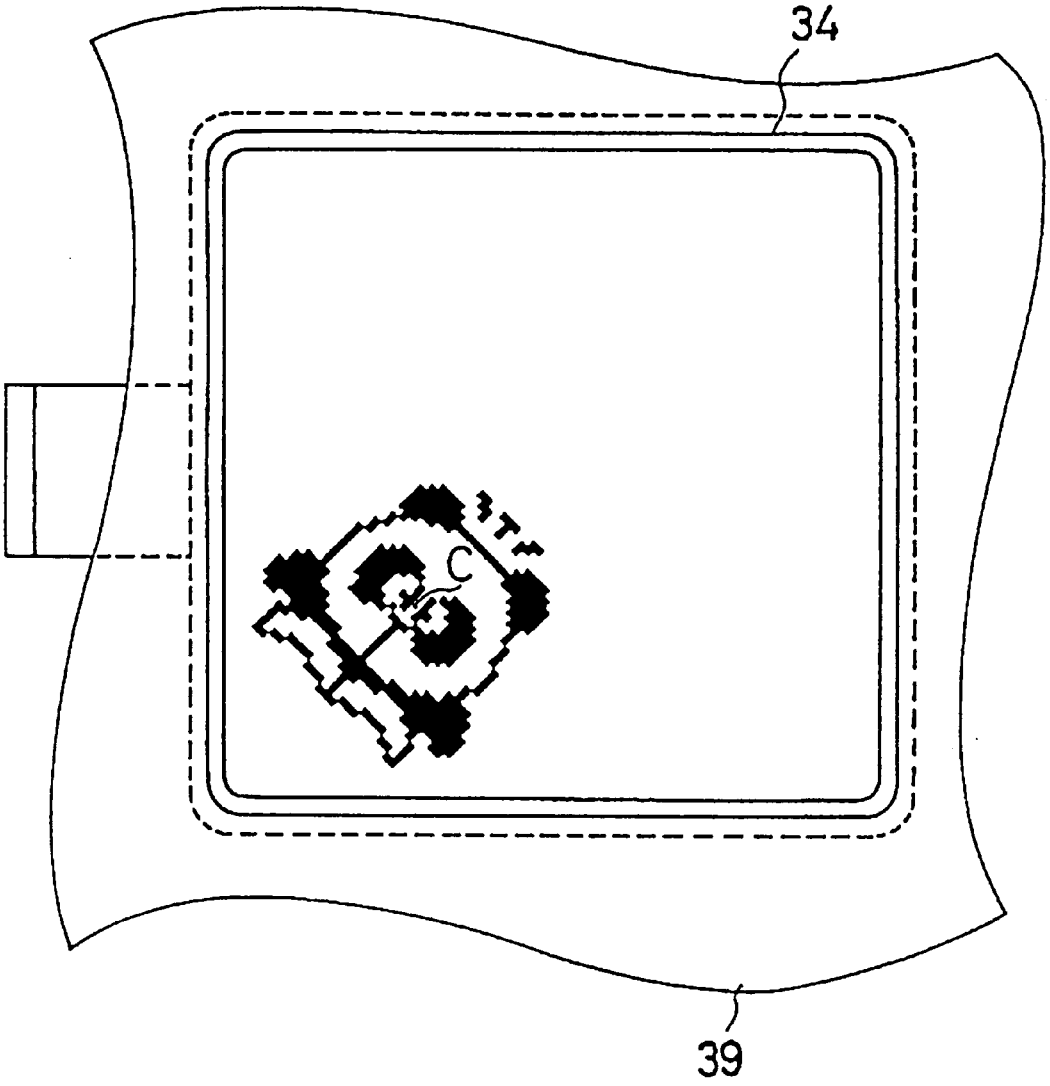
FIG. 11 is a plan view of the frame wherein the "panda" pattern is sewn on the work sheet.

Specifically, as a result of embroidery sewing based on the edited sewing data, the "panda" pattern is sewn, as shown in FIG. 11, at the sewing designation position 41 indicated by the simple sewing designation mark 40 drawn in advance on the work sheet 39 and in the designation direction.

Figure 12:
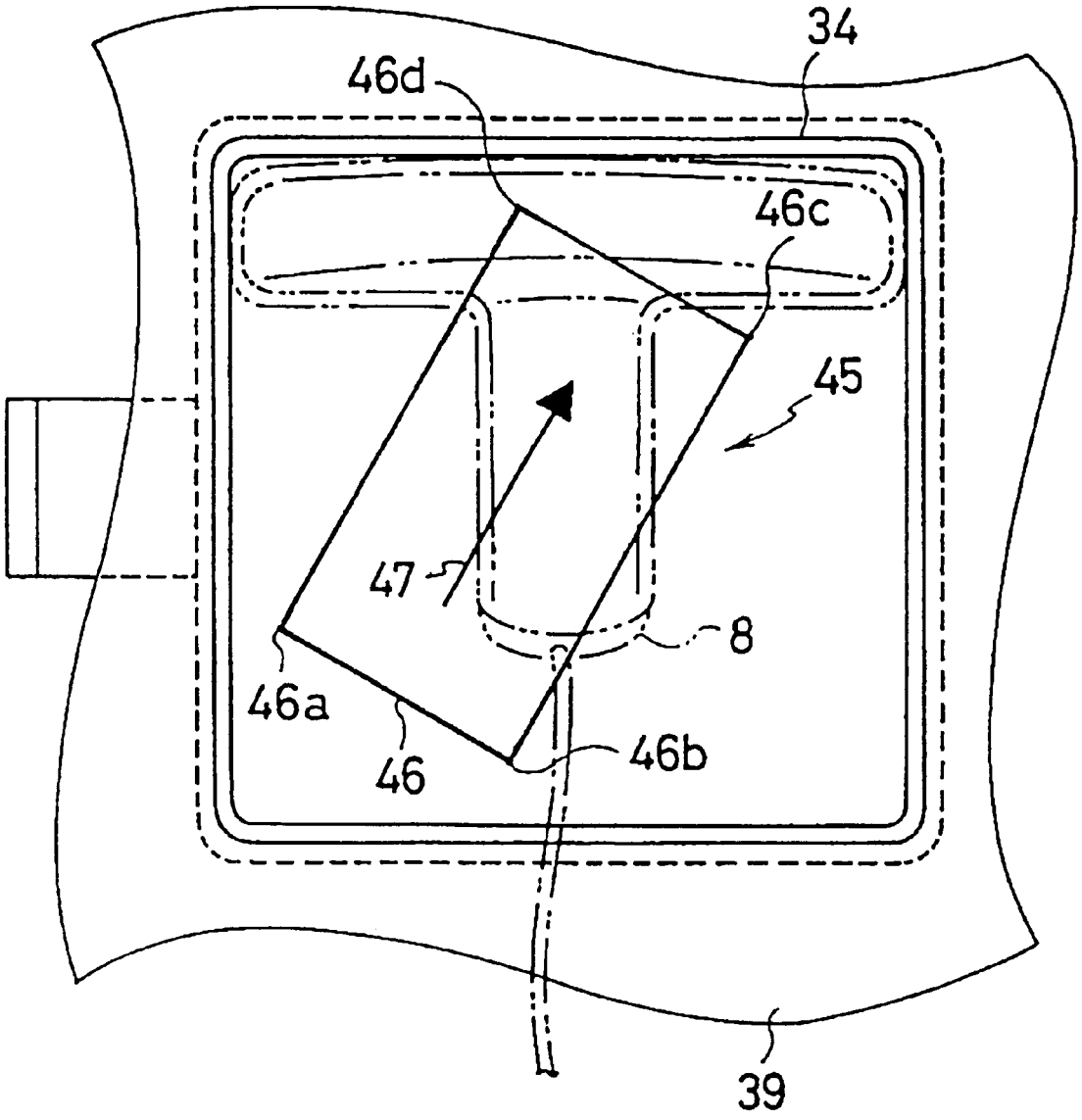
FIG. 12 is a plan view of the frame wherein a sewing reference designation mark is drawn on the work sheet, corresponding to FIG. 10.

Meanwhile, FIG. 12 shows an example that a standard sewing designation mark 45 constituted of a rectangular frame 46 and a direction designating arrow 47 is drawn with a tailor's chalk on a work sheet 39 set in an embroidery frame 34. Similar to the above-mentioned case, the standard sewing designation mark 45 is read in by the handy scanner 8 and the image data on the mark 45 is analyzed in S22 where the sewing designation position and the pattern size are determined based on the rectangular frame 46 and the designation direction based on the direction designating arrow 47.

Figure 13:
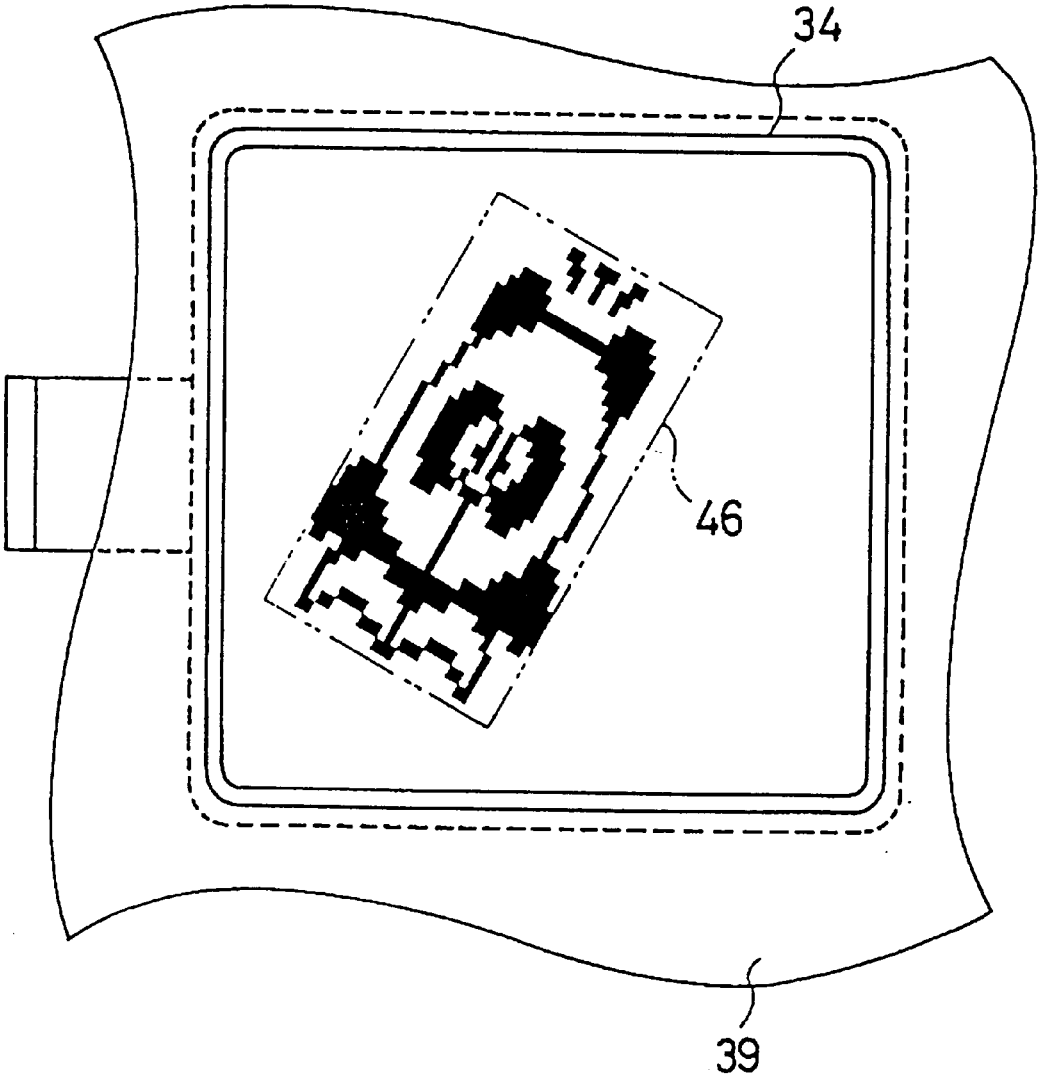
FIG. 13 is a plan view of the frame wherein the "panda" pattern is sewn on the work sheet.

Furthermore, the enlarging scale in a vertical direction and that in a lateral direction are determined respectively so that four base points $P_a$ to $P_d$ of the "panda" pattern correspond to four corner points 46*a* to 46*d* of the rectangular frame 46. In the edit control in step S24, each needle location data is changed according to the determined enlarging scales in a vertical and lateral directions, and the coordinate of each needle location data is also changed so that the pattern direction corresponds to the designation direction, providing final sewing data. The pattern of "panda" is embroidered based on the final sewing data as shown in FIG. 13. Specifically, the panda pattern is sewn at the designation position, in the designation direction, and in the pattern size indicated by the standard designation mark 45 drawn in advance on the work sheet 39.

Here, the process in S22 of the edit control constitutes mark analysis means in the invention and the process in step S24 constitutes edit means.

Next, the effect of the edit control will be explained.

By simply reading the simple sewing designation mark 40 that has been drawn in advance on the work sheet 39 held by the embroidery frame 34 by the handy scanner 8, the sewing data on the embroidery pattern to be sewn can be edited so that the position and direction of the embroidery pattern when actually sewn on the work sheet 39 correspond to the designation position and direction indicated by the simple sewing designation mark 40. Accordingly, a preparation work of setting the work sheet 39 in the embroidery frame 34 can be simplified. Manual operations to edit the sewing data can be omitted. Thus, the efficiency of sewing operations can largely be improved.

In the case of the standard sewing designation mark 45 drawn in advance on the work sheet 39, similarly, by simply reading the standard mark 45 by the handy scanner 8, the sewing data on the embroidery pattern to be sewn can be edited so that the position, direction, and size of the embroidery pattern when actually sewn on the work sheet 39 correspond to those indicated by the standard sewing designation mark 45. This makes it possible to simplify a preparation work of setting the work sheet 39 in the embroidery frame 34. Manual operations to edit the sewing data can be omitted. Thus, the efficiency of sewing operations can largely be improved.

Figure 14:
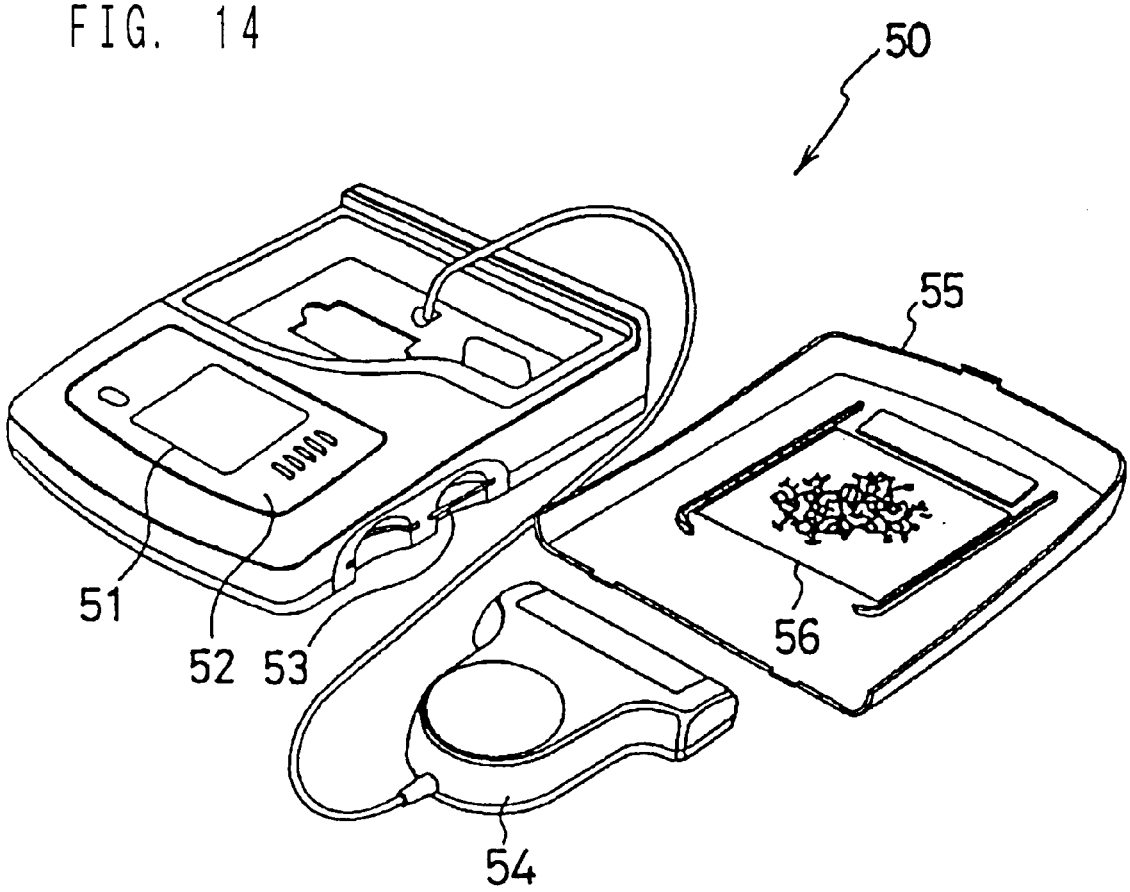
FIG. 14 is a schematic perspective view of a pattern data editing device in the embodiment according to the present invention.

Meanwhile, a pattern data editing device 50 with a color handy scanner 54 shown in FIG. 14 may be used. In this device 50, a pattern drawn on an original paper 56 is read by the scanner 54 as an embroidery pattern, while the sewing data on the embroidery pattern is edited so that the embroidery pattern corresponds to a sewing designation mark and the edited sewing data is stored in a RAM card 53, which is inserted in the embroidery machine M through the slot 2*a*.

The pattern data editing device 50 is provided with a small-sized crystal liquid display 51, a keyboard 52, and the color handy scanner 54, and the RAM card 53 insertable in the device 50. The device 50 contains a control unit constructed of a microcomputer for executing various controls such as an image reading process, an image analysis process, and an image edit processing.

Figure 15:
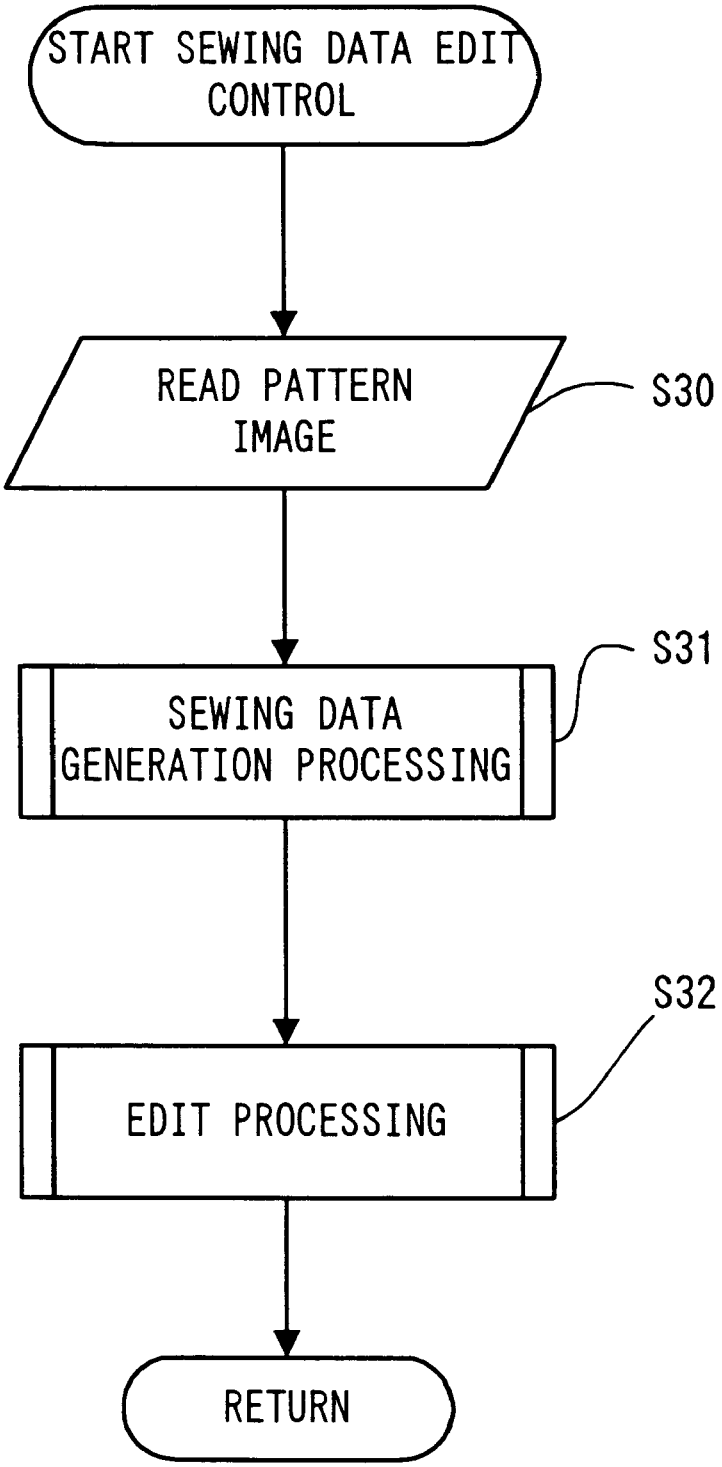
FIG. 15 is a flowchart of a routine of sewing data editing control.

To sew an embroidery pattern of "flower" with three primary colors on a work sheet 39, the sewing data edit control as shown in FIG. 15 is executed.

To start the control, at first, the original paper 56 on which the colorful pattern of "flower" has been drawn is put at a predetermined place on a cover member 55 of the device 50. Subsequently, the sewing data edit control starts with reading the color image of the pattern with the color handy scanner 54 (S30). Based on the color image data, each embroidery region of color pattern units of, for example, three primary colors (red, blue, and yellow) is determined by image analysis, and further the needle location data, namely, the sewing data is determined for every color pattern unit by processing (S31).

Sequentially, the edit control for editing the sewing data on the "flower" pattern is executed in the same manner as shown in FIG. 6. The final edited sewing data which can actually be sewn as a pattern is written in the RAM card 53 (S32). When the RAM card 53 is connected to the connector 18 of the embroidery sewing machine M, the final sewing data is read from the RAM card 53 to start embroidery sewing. As a result thereof, the sewing data on the embroidery pattern "flowers" can be automatically edited so that the position and direction at the time the embroidery pattern of "flower" is sewn on the work sheet 39 equal to the position and direction designated by the marks 40 and 45 drawn in advance on the work sheet 39 set in the embroidery frame 34. A preparatory work of setting the work sheet 39 in the embroidery frame 34 can be simplified and, accordingly, manual operations to edit the sewing data can be omitted. Thus, the efficiency of sewing operations can largely be improved.

The present invention may be embodied in other specific forms without departing from the spirit or essential characteristics thereof.

For instance, the sewing designation marks 40 and 45 drawn in advance on the work sheet 39 may be read in with an installed type image reader which reads in images by irradiating them with a light beam.

The embroidery sewing machine M may be provided with an image reader such as a CCD camera attached face-down to the head portion 4. In this case, it is arranged that the image reader reads the sewing designation marks 40 and 45 drawn on the work sheet 39 held by the embroidery frame 34 when moved in a main- and sub-scanning directions. The image reader attached to the head portion 4 may take a picture of the sewing designation marks 40 and 45 at a time.

The sewing data on the embroidery pattern to be sewn may be edited in relation to any one of the sewing designation position and the designation direction based on the image data on the read simple sewing designation mark 40. Similarly, the sewing data on the embroidery pattern to be sewn may be edited in relation to any one of the sewing designation position and the designation direction based on the image data on the read standard sewing designation mark 45.

Instead of the ROM card 27, a magnetic disk which stores data on a plurality of patterns may be used by being inserted in a floppy disk drive (FDD) of the control unit 20. Other medium such as a compact disc, a CD-ROM, a magneto-optic disk, etc. may be used.

The above mentioned embroidery pattern sewing control program and the edit processing control program are just a few examples of the present invention, and those control programs may be modified and also be stored in other forms.

For example, in the above embodiment, the ROM 24 of the control unit 20 previously stores the pattern data on a plurality of embroidery patterns and, in accordance with the edit processing control program previously stored, the control unit 20 executes analysis processing to analyze the image data of the sewing designation mark that has been drawn in advance on the work sheet, the image data having been read by the handy scanner, to determine at least one of the position, direction, and pattern size of the embroidery pattern to be sewn on the work sheet, and executes edit processing to edit the pattern data read from the ROM 24 so that the position, direction, and pattern size of the pattern data correspond respectively to the determined position, direction, and pattern size of the embroidery pattern to be sewn. Instead of being stored in advance in the control unit 20 of the embroidery sewing machine M, the above pattern data and control programs may be stored in an external memory medium (e.g., a floppy disc, a CD-ROM, etc.). In this case, the memory medium is set in the embroidery sewing machine M to execute the analysis and edit processing control programs.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An embroidery sewing machine including:

an embroidery frame which holds a work sheet on which a sewing designation mark has been drawn in advance;

a pattern data memory which stores pattern data on a plurality of embroidery patterns;

an image reading device for reading the sewing designation mark drawn on the work sheet;

means for analyzing image data of the sewing designation mark read by the image reading device to determine at least one of a first sewing position and a first sewing direction of an embroidery pattern to be sewed on the work sheet;

means for editing the pattern data, prior to sewing of the embroidery pattern on the work sheet based on the pattern data read from the pattern data memory, so that one of a second sewing position and a second sewing direction of the embroidery pattern in the pattern data corresponds to one of the first sewing position and the first sewing direction of the embroidery pattern determined by the mark analysis means; and a sewing device which sews the embroidery pattern on the work sheet held in the embroidery frame based on the pattern data edited by the edit means.

2. An embroidery sewing machine according to claim 1, wherein the mark analysis means analyzes the image data of the sewing designation mark to determine both the first sewing position and direction, and the edit means edits the pattern data so that both the second sewing position and direction of the embroidery pattern in the pattern data correspond to both the first sewing position and direction.

3. An embroidery sewing machine according to claim 1, wherein the sewing designation mark includes information concerning a size of the embroidery pattern to be sewed, and the mark analysis means analyzes the image data of the sewing designation mark to determine the pattern size.

4. An embroidery sewing machine according to claim 3, wherein the pattern data includes pattern size data on the embroidery pattern, and the edit means edits the pattern data so that the pattern size data in the pattern data corresponds to the pattern size determined by the mark analysis means.

5. An embroidery sewing machine according to claim 4, wherein the sewing designation mark is a cross mark comprising a straight line with an arrow and another straight line, both intersecting at right angles.

6. An embroidery sewing machine according to claim 5, wherein an intersection point between the straight line with an arrow and another straight line of the cross mark corresponds to the first sewing position, and a direction indicated by the arrow of the straight line with the arrow corresponds to the first sewing direction.

7. An embroidery sewing machine according to claim 6, wherein the second sewing position corresponds to a center point of the embroidery pattern defined by an external size determined based on the pattern size data, and the edit means produces sewing data to be sewed by the sewing device by changing coordinates of the pattern data so that the intersection point of the cross mark corresponds to the center point of the embroidery pattern defined by the external size and the second sewing direction corresponds to the direction indicated by the arrow of the cross mark.

8. An embroidery sewing machine according to claim 1, wherein the image reading device comprises a handy scanner which reads the image data of the sewing designation mark under manual control.

9. An embroidery sewing machine according to claim 8, the handy scanner has width that is substantially equal to that of the embroidery frame.

10. An embroidery sewing machine according to claim 4, wherein the sewing designation mark comprises a rectangular frame and a direction indicating line with an arrow arranged in the rectangular frame.

11. An embroidery sewing machine according to claim 10, wherein a center point of the rectangular frame corresponds to the first sewing position, a direction indicated by the direction indicating line with an arrow corresponds to the first sewing direction, and an external size of the rectangular frame corresponds to the pattern size of the embroidery pattern.

12. An embroidery sewing machine according to claim 11, wherein the edit means produces sewing data to be sewed by the sewing device by calculating a vertical enlargement rate and a lateral enlargement rate of the pattern data so that four base points included in the pattern size data correspond to four corner points defining four corners of the rectangular frame, and by changing coordinates of the pattern data in accordance with the calculated vertical and lateral enlargement rates.

13. An embroidery pattern data editing device including:

a pattern data memory which stores pattern data on a plurality of embroidery patterns;

an image reading device for reading a sewing designation mark that has been drawn in advance on a work sheet held in an embroidery frame;

means for analyzing image data of the sewing designation mark read by the image reading device to determine at least one of a first sewing position and a first sewing direction of an embroidery pattern to be sewed on the work sheet; and means for editing the pattern data, prior to sewing of the embroidery pattern on the work sheet based on the pattern data read from the pattern data memory, so that one of a second sewing position and a second sewing direction of the embroidery pattern in the pattern data corresponds to one of the first sewing position and the first sewing direction of the embroidery pattern determined by the mark analysis means.

14. An embroidery data editing device according to claim 13, wherein the mark analysis means analyzes the image data of the sewing designation mark to determine both the first sewing position and direction, and the edit means edits the pattern data so that both the second sewing position and direction of the embroidery pattern in the pattern data correspond to both the first sewing position and direction.

15. An embroidery data editing device according to claim 13, wherein the sewing designation mark includes information concerning a size of the embroidery pattern to be sewed, and the mark analysis means analyzes the image data of the sewing designation mark to determine the pattern size.

16. An embroidery data editing device according to claim 15, wherein the pattern data includes pattern size data on the embroidery pattern, and the edit means edits the pattern data so that the pattern size data in the pattern data corresponds to the pattern size determined by the mark analysis means.

17. An embroidery data editing device according to claim 16, wherein the sewing designation mark is a cross mark comprising a straight line with an arrow and another straight line, both intersecting at right angles.

18. An embroidery data editing device according to claim 17, wherein an intersection point between the straight line with an arrow and another straight line of the cross mark corresponds to the first sewing position, and a direction indicated by the arrow of the straight line with the arrow corresponds to the first sewing direction.

19. An embroidery data editing device according to claim 18, wherein the second sewing position corresponds to a center point of the embroidery pattern defined by an external size determined based on the pattern size data, and the edit means produces sewing data to be sewed by the sewing device by changing coordinates of the pattern data so that the intersection point of the cross mark corresponds to the center point of the embroidery pattern defined by the external size and the second sewing direction corresponds to the direction indicated by the arrow of the cross mark.

20. An embroidery data editing device according to claim 13, wherein the image reading device comprises a handy scanner which reads the image data of the sewing designation mark under manual control.

21. An embroidery data editing device according to claim 20, the handy scanner has width that is substantially equal to that of the embroidery frame.

22. An embroidery data editing device according to claim 16, wherein the sewing designation mark comprises a rectangular frame and a direction indicating line with an arrow arranged in the rectangular frame.

23. An embroidery data editing device according to claim 22, wherein a c enter point of the rectangular frame corresponds to the first sewing position, a direction indicated by the direction indicating line with an arrow corresponds to the first sewing direction, and an external size of the rectangular frame corresponds to the pattern size of the embroidery pattern.

24. An embroidery data editing device according to claim 23, wherein the edit means produces sewing data to be sewed by the sewing device by calculating a vertical enlargement rate and a lateral enlargement rate of the pattern data so that four base points included in the pattern size data correspond to four corner points defining four corners of the rectangular frame, and by changing coordinates of the pattern data in accordance with the calculated vertical and lateral enlargement rates.

25. An embroidery sewing machine including:

an embroidery frame which holds a work sheet on which a sewing designation mark has been drawn in advance;

a pattern data memory which stores pattern data on a plurality of embroidery patterns;

an image reading device for reading the sewing designation mark drawn on the work sheet;

means for analyzing image data of the sewing designation mark read by the image reading device to determine a first sewing position, a first sewing direction, and a pattern size of an embroidery pattern to be sewed on the work sheet;

means for editing the pattern data, prior to sewing of the embroidery pattern on the work sheet based on the pattern data read from the pattern data memory, so that a second sewing position, a second sewing direction of the embroidery pattern, and a pattern size in the pattern data respectively corresponds to the first sewing position, the first sewing direction, and the pattern size of the embroidery pattern determined by the mark analysis means; and a sewing device which sews the embroidery pattern on the work sheet held in the embroidery frame based on the pattern data edited by the edit means.

26. An embroidery pattern data editing memory medium used for editing pattern data of a plurality of embroidery patterns, said memory medium storing:

a mark analysis program for analyzing image data of a sewing designation mark read by an image reading device to determine at least one of a first sewing position and a first sewing direction of an embroidery pattern to be sewed on the work sheet, the sewing designation mark having been drawn in advance on a work sheet held in an embroidery frame; and a pattern data edit program for editing the pattern data, prior to sewing of the embroidery pattern on the work sheet based on the pattern data read from the pattern data memory, so that one of a second sewing position and a second sewing direction of the embroidery pattern in the pattern data corresponds to one of the first sewing position and the first sewing direction of the embroidery pattern determined in accordance with the mark analysis program.

* * * * *